United States Patent [19]

Tourtellier et al.

[11] Patent Number: 4,524,698

[45] Date of Patent: Jun. 25, 1985

[54] MODULAR RAIL MEMBER FOR THE TRANSLATION OF LOAD-BEARING CARRIAGES ON AN OVERHEAD TRACK

[75] Inventors: Jean-Louis Tourtellier; Roger Schoen, both of Mulhouse, France

[73] Assignee: Etablissements Tourtellier S.A., France

[21] Appl. No.: 414,078

[22] Filed: Sep. 2, 1982

[30] Foreign Application Priority Data

Jun. 15, 1982 [FR] France ..... 82 10563

[51] Int. Cl.[3] ..... E01B 25/22

[52] U.S. Cl. ..... 104/107; 104/94; 104/110; 16/94 R

[58] Field of Search ..... 104/106–109, 104/94, 95, 110, 111; 105/155; 16/96 R, 94 R, 95 R

[56] References Cited

U.S. PATENT DOCUMENTS

| | | | |
|---|---|---|---|
| 1,178,196 | 4/1916 | Willard | 104/110 |
| 1,972,931 | 9/1934 | Haddlesay | 104/108 |
| 3,043,408 | 7/1962 | Attwood | 104/107 X |
| 3,974,777 | 8/1976 | Monne | 104/106 |
| 3,987,877 | 10/1976 | Bulanchuk | 104/108 X |

*Primary Examiner*—David A. Scherbel
*Assistant Examiner*—Glenn B. Foster
*Attorney, Agent, or Firm*—Darby & Darby

[57] ABSTRACT

A modular rail member facilitates the translation of load-bearing carriages on an overhead track and comprises a vertical wall formed with two sections of different lengths which are spaced apart from and connected to each other by a flare having a vertical web. The two spaced-apart sections have ends curved in the same direction, and a vertical plane passing through the horizontal outer edges of the curved ends is set back relative to the vertical web.

5 Claims, 8 Drawing Figures

MODULAR RAIL MEMBER FOR THE TRANSLATION OF LOAD-BEARING CARRIAGES ON AN OVERHEAD TRACK

The invention relates to a modular shaped rail member for the translation of load-bearing carriages on an overhead track, in particular on a suspended tubular monorail.

A suspension and attachment system for the rails of overhead tracks has already been disclosed in French Pat. No. 353,971. It consists of two members of stamped steel sheet, a bottom hook-shaped member which receives rails on which the rollers of the carriage bearing the hook reciving the loads can run, and an upper claw-shaped member which is in the shape of a T or an I beam. The two members of the suspension system are attached by means of bolts.

French Pat. No. 1,334,541 also teaches a shaped metal piece whose section is designed to support a rail for overhead travel, and which is intended for the displacement of couplings equipped with rollers. This piece consists of a web supplemented by two parallel flanges of different widths disposed on the same side of the web, having, along their free edge, a raised border, at least one of said flanges being capable of forming an assembly face intended to support another such shaped piece individually.

These known devices, however, composed of two members, permit only a single use for a given type of load carriage, and require a superstructure to which these devices are fastened.

Likewise, French Pat. No. 1,233,923 teaches a rail member for a tubular monorail or an electric feeder conduit. This rail member has a vertical wall, each end of which is curved in a direction opposite that of the other either to form one of the tracks for the monorail conveyor carriage rollers or for the conduit, or, in co-operation with a suitable hanger, to form the point of suspension of the rail from the bearing beam. The web of this rail member has a double bend and is composed of two vertical wall sections of different but predetermined lengths, joined together by a horizontal wall. Two sections of identical length of two rail members placed back to back form the tubular rail of a manual or electrical monorail or of an electric feeder conduit.

Although it is true that this rail member permits the transformation of a manual monorail into an electric monorail, while retaining the same elements and thus considerably reduces the cost of transformation, inasmuch as the same rail member can be used either for manual monorail or an electric monorail, it is nonetheless true that it permits only this transformation, and hence the use of this rail member is very limited. Moreover, it has several drawbacks, in particular when two such members are to be assemblied to form the tubular monorail, it is necessary to drill one of the sections of the vertical wall for the passage of elements of attachment. Thus, when proceeding with the transformation, the various holes will weaken the bearing section, and it is necessary to reduce the load capacity.

In addition, a bearing beam is required, which limits the site of installation of the monorail in a shape as it may interfere with the existing framework.

It is an object of the present invention to provide a modular shaped rail member that permits the translation of load bearing carriages wherein the load ranges from zero to one thousand five hundred kilos, this range of loads being obtained precisely by the modular nature of the rail member. Hence, with the aid of a single rail member, it is possible to expand the possibilities of utilization and thereby increase the efficiency of the number of such members used, thus reducing the costs of production, storage, installation, etc.

Furthermore, since the modular shaped rail member according to the invention is self-supporting, it does not have to be fastened to the superstructure by means of a linear stiffener, as the prior art rail members.

By combination or reversal of the rail members of the present invention, it is possible to expand the range of rail members to encompass all industrial handling systems in particular, monorail, birail, overhead, ground, etc.

Moreover, the rail member of the present invention responds well to the demand for an electrified as well as a manual rail member. Its easy electrification makes it possible to support up to ten protected power conductors, a much larger number than those now called for in the electrification of material handling rails.

The upper grooves, with which the rail member of the present invention is equipped, permit its most convenient attachment to the superstructure of a building since the fastening points can be located at any point on the rail member.

Therefore, the present invention relates to a modular, shaped rail member for the translation of load-bearing carriages on an overhead track, in particular on a suspended, tubular monorail, comprising a vertical wall composed of two sections of vertical wall of different lengths, characterized in that the two vertical wall sections have ends curved in the same direction, wherein the vertical plane of alignment passing through the outer horizontal edge of these curved ends, is set back relative to the vertical web of a flare connecting the two vertical wall sections together.

The invention will be clearly understood by reference to the following description given by way of a non-limiting example, and to the attached drawing in which.

Figure 1:
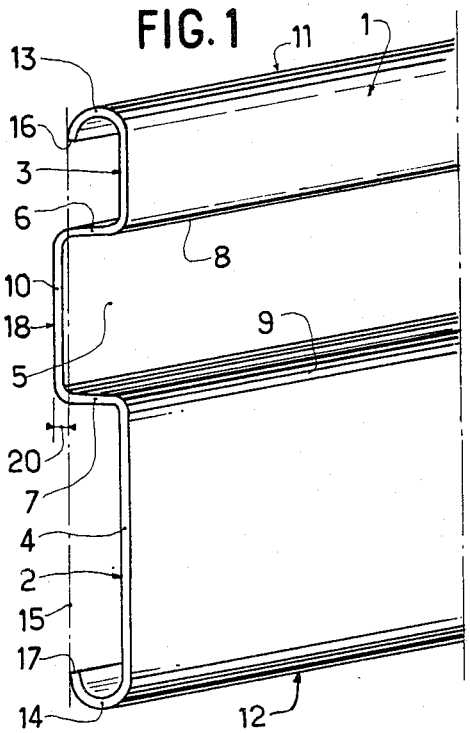
FIG. 1 is a perspective view of a modular rail member according to the present invention.
Figure 2:
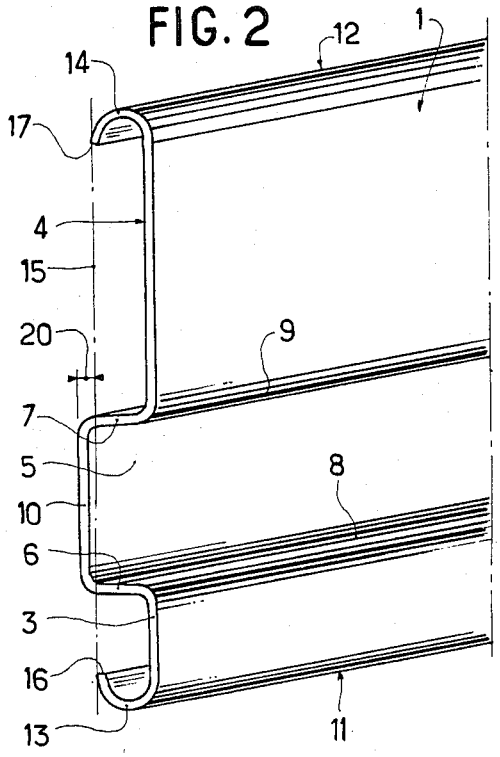
FIG. 2 is a symmetrical view of FIG. 1 along the horizontal plane.

Reference is now made to FIGS. 1 and 2.

Rail 1 has vertical wall 2 composed of two vertical wall sections 3 and 4. Sections 3 and 4 are joined together by flare 5 having a U-shaped section. Parallel arms 6 and 7 of flare 5 terminate, on one hand, at ends 8 and 9 of the sections 3 and 4 and on the other hand, at vertical web 10.

Free ends 11 and 12 of sections 3 and 4 are curved in the same direction. These curved ends 13 and 14 lie on the same side as flare 5.

Vertical plane of alignment 15 passing through the horizontal outer edges 16 and 17 of curved ends 13 and 14, is set back relative to vertical web 10 of flare 5. As a result, outer face 18 of web 10 projects relative to vertical plane of alignment 15.

As shown in FIGS. 3 to 6, by adjoining outer face $18_1$ of web $10_1$ of flare $5_1$ of a first rail member $1_1$ back to back with outer face $18_2$ of web $10_2$ of flare $5_2$ of second rail member $1_2$, spacing 19 is obtained between the outer edges $16_1$, $17_1$ and $16_2$, $17_2$ of curved ends $13_1$, $14_1$ and $13_2$, $14_2$, whose width is a function of the width of set-back 20 (see FIGS. 1 and 2).

Lower spacing $19_1$ serves as a passage for the carriage (not shown) whose rollers move to tracks 21 and 22 formed by inner faces 23 and 24 of curved ends $13_1$, $13_2$ or $14_1$, $14_2$. Upper spacing $19_2$ allows the installation of fastening means to attach the rail to the superstructure of the building. By reason of the characteristics of these rail members, the rail obtained is self-supporting and it becomes unnecessary to introduce a framing between the superstructure of the building and the rail, to serve as a support for said rail.

In addition, the disposition of rail members $1_1$ and $1_2$ as indicated above, produces two superposed inner corridors 25, 26 and two lateral outer corridors 27, 28.

Figure 3:
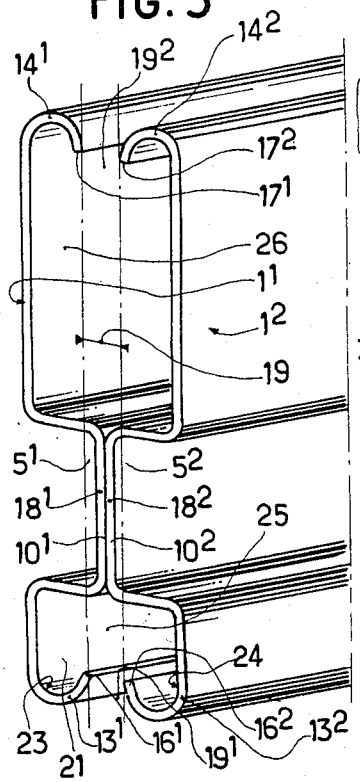
FIGS. 3 to 6 are perspective views of tubular monorails constructed with the aid of the modular rail member of the present invention.

According to FIG. 3, inner corridor 25 is disposed below inner corridor 26, and serves as a guide channel for manually displaced carriages.

Figure 4:
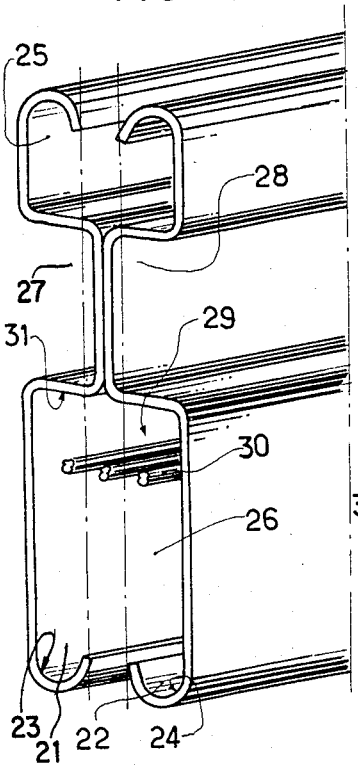
Figure 5:
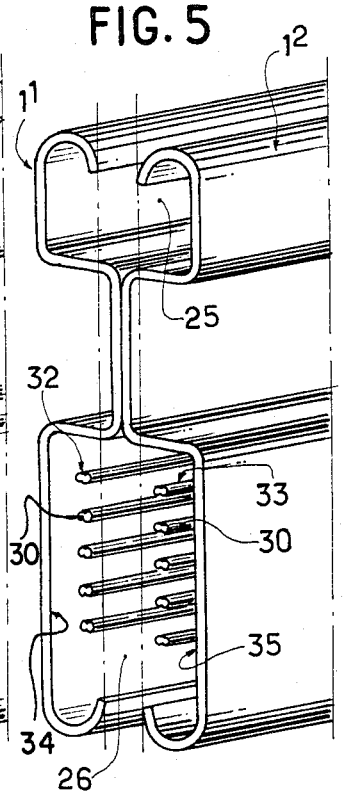

According to FIGS. 4 and 5, inner corridor 25 is disposed above the inner corridor 26. The latter can contain either horizontal network 29 of electrical conductors 30 integral with upper face 31 of inner corridor 26 (see FIG. 4), or one or more vertical networks 32, 33 of electrical conductors 30 integral with vertical faces 34, 35 of inner corridor 26 (see FIG. 5). In so doing, an electrical monorail is obtained. Its easy electrification can receive up to ten protected power conductors, a number much larger than those presently called for in the electrification of overhead tracks for materials handling.

Figure 6:
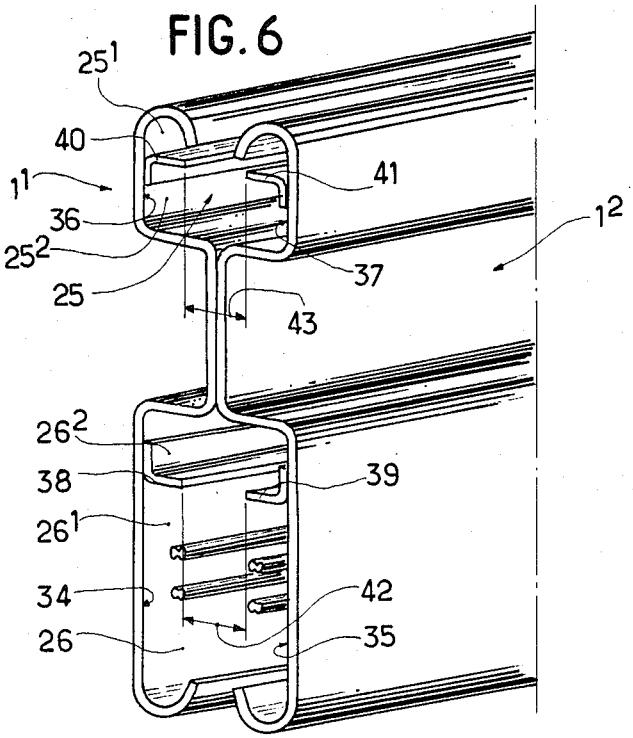

Reference is now made to FIG. 6.

According to another embodiment, vertical faces 34, 35 of inner corridor 26, and vertical faces 36, 37 of inner corridor 25 are provided with guides 38, 39, 40, and 41. As a result, inner corridor 25 is divided into two superimposed parallel corridors $25_1$ and $25_2$, and inner corridor 26 is likewise divided into two superimposed parallel corridors $26_1$ and $26_2$. Spaces 42 and 43 are provided between guides 38, 39, and 40, 41, respectively. Supplementary corridors $25_2$ and $26_2$, can receive different means of entrainment such as chains, scrapers, cables, etc. Consequently, the overhead track, obtained by the assembly of rail members $1_1$ and $1_2$, can be given a certain inclination, ranging up to the vertical, and this track can be used as an elevator. Furthermore, the suspended, tubular monorail can be given, either wholly or in part, a steep inclination, with the provision, in corridors $25_2$ and $26_2$, of an entrainment for the carriages either by a chain or by a rack and pinion system (not shown).

Figure 7:
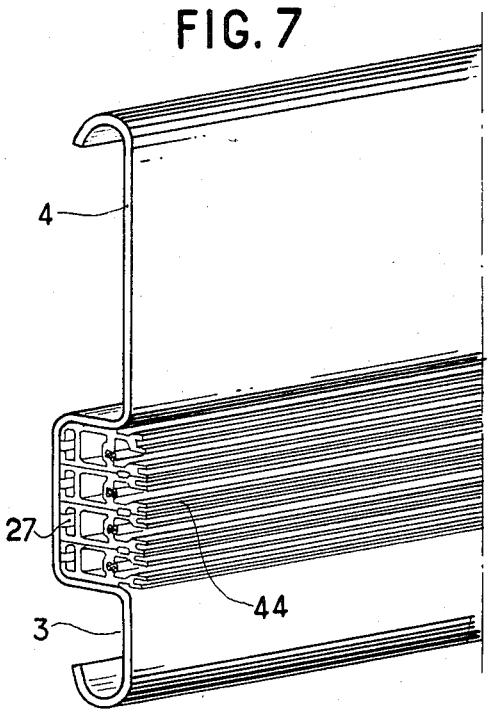
FIGS. 7 and 8 are perspective views of non-limiting examples of utilization of the modular rail-member of the present invention.
Figure 8:
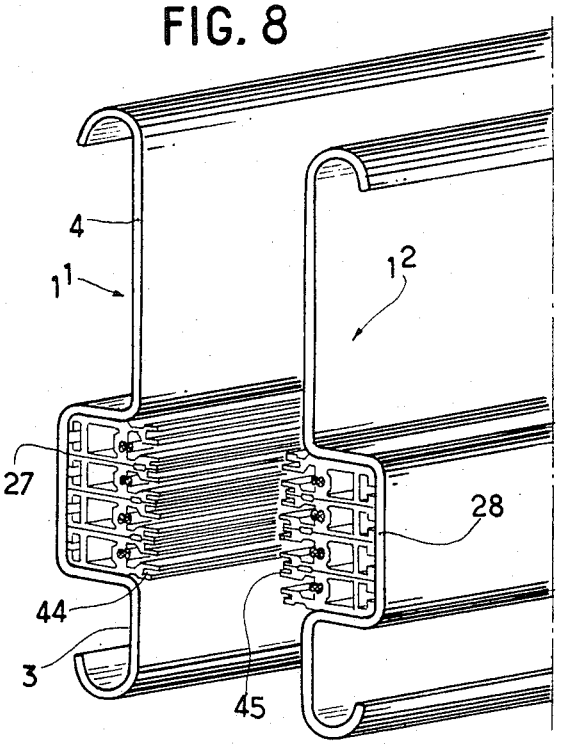

Reference is now made to FIGS. 7 and 8 representing two possibilities of utilization of inner corridors 27, 28, in which bundles of insulated electricals 44 and 45 are lodged. It is also possible, of course, to lodge other elements in these outer corridors 27, 28, such as pipes for water or compressed air, telephone lines, etc.

The possibilities of utilization are not, of course, limited to the few examples cited above, and any utilization of rail member 1 having the characteristics of the present invention falls within the scope thereof.

Although the invention has been described in regard to a particular form of embodiment, the invention is understood that it is in no way limited to such embodiment and that many modifications of the various elements disclosed herein can be made without thereby departing from the scope and the spirit of the invention.

We claim:

1. A modular rail member for the translation of load-bearing carriages on an overhead track, in particular a suspended, tubular monorail, said modular rail member comprising a vertical wall formed with two sections of different lengths which are spaced apart from and connected to each other by a flare having a vertical web, characterized in that said two spaced apart sections have ends curved toward the same direction, and vertical plane passing through the horizontal outer edges of said curved ends being set closer to the plane of the web than to the plane connecting the two vertical sections.

2. A rail member according to claim 1, characterized in that a rail, obtained by adjoining the web of the flare of a first modular member back to back with the web of the flare of a second modular member, has two superposed inner corridors and two lateral, outer corridors, the rail formed thereby being capable of self-support and adapted for invertible use as the rail.

3. A rail member according to claim 2, characterized in that each inner corridor has a space for accommodating trolleys and/or fastening means.

4. A rail member according to claim 3, characterized in that each inner corridor has, on its inner faces a plurality of guides separated from one another by said space.

5. A rail member according to claim 4, characterized in that each inner corridor has two superposed parallel corridors separated by a plurality of guides.

* * * * *